US010271625B2

(12) United States Patent
Wang

(10) Patent No.: US 10,271,625 B2
(45) Date of Patent: Apr. 30, 2019

(54) DOUBLE OPEN END ZIPPER FOR BOTH END POSITIONING-BASED LUGGAGE AND ITS METHOD OF FABRICATION

(71) Applicant: GENMORE ZIPPER CORPORATION, New Taipei (TW)

(72) Inventor: Lien-Chou Wang, New Taipei (TW)

(73) Assignee: GENMORE ZIPPER CORPORATION, New Taipei (TW)

( * ) Notice: Subject to any disclaimer, the term of this patent is extended or adjusted under 35 U.S.C. 154(b) by 498 days.

(21) Appl. No.: 15/059,403

(22) Filed: Mar. 3, 2016

(65) Prior Publication Data

US 2017/0251771 A1 Sep. 7, 2017

(51) Int. Cl.

| | |
|---|---|
| ***A45C 13/04*** | (2006.01) |
| ***A45C 13/10*** | (2006.01) |
| ***A45C 7/00*** | (2006.01) |
| ***A45C 13/36*** | (2006.01) |
| *A44B 19/38* | (2006.01) |

(52) U.S. Cl.

CPC ..... *A45C 13/103* (2013.01); *A45C 7/0027* (2013.01); *A45C 13/36* (2013.01); *A44B 19/382* (2013.01)

(58) Field of Classification Search

CPC ..... A45C 7/0031; A45C 7/0022; A45C 7/005; A45C 3/00; A45C 5/03; A45C 7/00; A44B 19/36; A44B 19/60; A44B 19/62; A44B 5/00; B29D 33/2591; Y10T 29/49782; Y10T 29/49783; Y10T 29/49785

USPC ..... 190/105, 103, 18 A, 104, 100

See application file for complete search history.

(56) References Cited

U.S. PATENT DOCUMENTS

| | | | | |
|---|---|---|---|---|
| 4,733,759 A * | 3/1988 | Shih-Chen | A45C 7/0068 | 190/103 |
| 5,307,908 A * | 5/1994 | Shyr | A45C 7/0068 | 190/103 |
| 5,664,652 A * | 9/1997 | Shamah | A45C 5/14 | 190/103 |
| 5,671,831 A * | 9/1997 | Chiu | A45C 5/14 | 190/103 |
| 6,021,874 A * | 2/2000 | Nykoluk | A45C 5/14 | 190/103 |
| 6,059,078 A * | 5/2000 | Nykoluk | A45C 5/14 | 190/103 |

(Continued)

*Primary Examiner* — Fenn C Mathew
*Assistant Examiner* — Cynthia F Collado
(74) *Attorney, Agent, or Firm* — Jackson IPG PLLC; Demian K. Jackson

(57) ABSTRACT

A double open end zipper for both end positioning-based luggage includes first and second housing members respectively equipped with an N-shaped plastic strip at the rim thereof, and a double open end zipper including first and second zipper tapes respectively stitched to the N-shaped plastic strips at the first and second housing members in reversed directions with the box and pin of the first zipper tape respectively disposed adjacent to the pin and box of the second zipper tape subject to the guidance of a mark line at each N-shaped plastic strip, a seam allowance constraint block located at an outer rear side of the box of each of the first and second zipper tapes, two zipper sliders respectively coupled to first and second zipper tapes, allowing adjustment of the combined storage capacity defined in between the first and second housing members.

5 Claims, 12 Drawing Sheets

(56) References Cited

U.S. PATENT DOCUMENTS

| | | | | |
|---|---|---|---|---|
| 6,305,513 | B1 * | 10/2001 | Lu | A45C 5/14 190/103 |
| 6,609,598 | B2 * | 8/2003 | Hsu | A45C 7/0027 190/103 |
| 7,143,878 | B2 * | 12/2006 | Selvi | A45C 5/03 190/103 |
| 7,699,149 | B2 * | 4/2010 | Lin | A45C 7/0022 190/103 |
| 9,101,186 | B2 * | 8/2015 | Lai | A45C 7/0027 |
| 9,826,808 | B2 * | 11/2017 | Yeh | A45C 5/03 |
| 2010/0236974 | A1 * | 9/2010 | Pedrazzi | A45C 11/20 206/542 |
| 2013/0092490 | A1 * | 4/2013 | Moon | A45C 7/0031 190/18 A |
| 2015/0034440 | A1 * | 2/2015 | Lai | A45C 7/0027 190/103 |
| 2016/0366995 | A1 * | 12/2016 | Yeh | A45C 5/03 |

* cited by examiner

DOUBLE OPEN END ZIPPER FOR BOTH END POSITIONING-BASED LUGGAGE AND ITS METHOD OF FABRICATION

BACKGROUND OF THE INVENTION

1. Field of the Invention

The present invention relates to luggage technology and more particularly, to the fabrication of a double open end zipper for both end positioning-based luggage, which has a seam allowance constraint block provided at an outer rear side of the box of each of the first and second zipper tapes for abutting against or attaching onto the associating N-shaped plastic strip at the first or second housing member before stitching, ensuring accurate control of stitching alignment and stacked stitching quality, preventing friction between the zipper sliders and the respective N-shaped plastic strips, facilitating sliding of the zipper sliders and avoiding stretching of the fabric tape bodies of the first and second zipper tapes.

2. Description of the Related Art

In the fabrication of a conventional hard shell luggage, the left and right zipper tapes 71,72 of a double open end zipper 7 are respectively stitched to the rims of the first housing member 81 and the second housing member 82 in an asymmetric manner (see reference 7' in FIG. 1). When the two zipper sliders 9 to force the longitudinal series of interlocking teeth of the left zipper tape 71 into engagement with the longitudinal series of interlocking teeth of the right zipper tape 72, the two longitudinal series of interlocking teeth may not be accurately meshed, causing one of the left and right zipper tapes 71,72 to protrude outwardly as the two zipper sliders 9 met up, at this time, the four wheels 83 at the bottom side of the first and second housing members 81,82 are not maintained in balance, affecting moving smoothness. At this time, a correction work is necessary. However, if a correction work cannot be performed at this time, the product becomes defective.

Further, when stitching the left and right zipper tapes 71,72 of the double open end zipper 7 to the rims of the first and second housing members 81, 82, a proper seam allowance must be well controlled. Improper control of the seam allowance will affect the sliding smoothness of the zipper sliders 9.

Further, according to the aforesaid conventional design, the first housing member 81 and the second housing member 82 are fixedly connected together by a flexible plastic sheet member that is directly stitched to the first housing member 81 and the second housing member 82. Thus, the first housing member 81 and the second housing member 82 are neither detachable, nor adjustable to expand the total storage capacity.

SUMMARY OF THE INVENTION

The present invention has been accomplished under the circumstances in view. It is the main object of the present invention to provide a double open end zipper for both end positioning-based luggage and its method of fabrication, which achieves accurate stitching of the first and second zipper tapes of the double open end zipper by marking a mark line as a stitching start point for stitching alignment, ensuring accurate engagement between the longitudinal series of teeth at the first zipper tape and the longitudinal series of teeth at the second zipper tape.

It is another object of the present invention to provide a double open end zipper for both end positioning-based luggage and its method of fabrication, which has a seam allowance constraint block provided at an outer rear side of the box of each of the first and second zipper tapes for abutting against or attaching onto the associating N-shaped plastic strip at the first housing member (lower housing member) or second housing member (upper housing member) before stitching, ensuring accurate control of stitching alignment and stacked stitching quality, preventing friction between the zipper sliders and the respective N-shaped plastic strips, facilitating sliding of the zipper sliders and avoiding stretching of the fabric tape bodies of the first and second zipper tapes.

It is still another object of the present invention to provide a double open end zipper for both end positioning-based luggage and its method of fabrication, which provides a T-shaped protector detachably mountable in between the first and second housing members to shield the boxes of the first and second zipper tapes, allowing expansion of the combined storage capacity of the first and second housing members and maintaining thee first and second housing members in a balanced manner.

To achieve these and other objects of the present invention, a double open end zipper for both end positioning-based luggage fabrication method comprises a step of fastening a first zipper tape and a second zipper tape to a first housing member (lower housing member) and a second housing member (upper housing member). This step is achieved by: attaching an N-shaped plastic strip to the rim of the first housing member (lower housing member), and then using a L-type gauge or like length measurement tool means to mark a mark line on the N-shaped plastic strip at the first housing member (lower housing member) as a stitching start point corresponding to the box of the first zipper tape, and then stitching the first zipper tape to the rim of the first housing member (lower housing member) in direction from the box toward the pin to the extent about 1~2 centimeters from the pin, and then coupling one zipper slider to the pin of the first zipper tape and moving the zipper slider to the box of the first zipper tape, and then attaching another N-shaped plastic strip to the rim of the second housing member (upper housing member), and then using the same L-type gauge or like length measurement tool means to mark a mark line on the N-shaped plastic strip at the second housing member upper housing member) as a stitching start point corresponding to the box of the second zipper tape, and then stitching the second zipper tape to the rim of the second housing member (upper housing member) in direction from the box toward the pin to the extent about 1~2 centimeters from the pin, and then coupling the other zipper slider to the pin of the second zipper tape and moving the zipper slider along to the box, and then coupling the zipper slider at the first zipper tape onto the pin of the second zipper tape and the zipper slider at the second zipper tape onto the pin of the first zipper tape. The double open end zipper for both end positioning-based luggage thus made further comprises a T-shaped protector detachably mountable in between the first housing member (lower housing member) and the second housing member (upper housing member) to shield the boxes of the first and second zipper tapes.

DETAILED DESCRIPTION OF THE INVENTION

Figure 3:
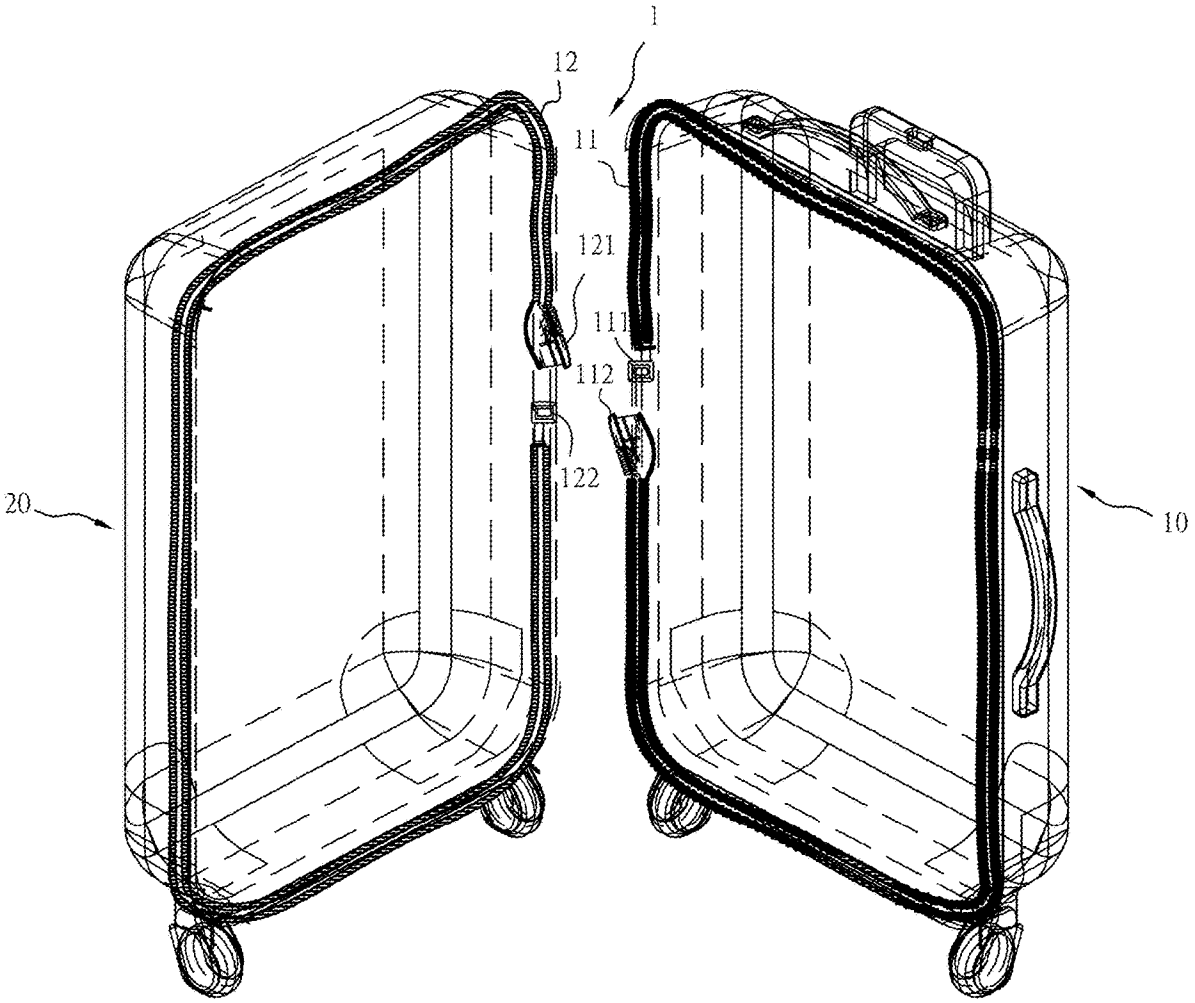
FIG. 3 corresponds to FIG. 2, illustrating the first housing member (lower housing member) and the attached first zipper tape separated from the second housing member (upper housing member) and the attached second zipper tape.

The invention provides a double open end zipper for both end positioning-based luggage and a method for the fabrication of the double open end zipper for both end positioning-based luggage. The method for the fabrication of the double open end zipper for both end positioning-based luggage is characterized as follows:

I: Zipper preparation: As illustrated in FIG. 3, prepare a double open end zipper 1 that comprises a first zipper tape 11 having a box 111 located at its one end and a pin 112 located at its opposite end, a second zipper tape 12 having a pin 121 located at its one end corresponding to the box 111 of the first zipper tape 11 and a box 122 at its opposite end corresponding to the pin 112 of the first zipper tape 11, and two zipper sliders 2, and then sleeve one zipper slider 2 onto the pin 112 of the first zipper tape 11 and then move the zipper slider 2 along the length of the first zipper tape 11 to the box 11 of the first zipper tape 11, and then sleeve the other zipper slider 2 onto the pin 121 of the second zipper tape 12 and then move the zipper slider 2 along the length of the second zipper tape 12 to the box 122 of the second zipper tape 12.

Figure 1:
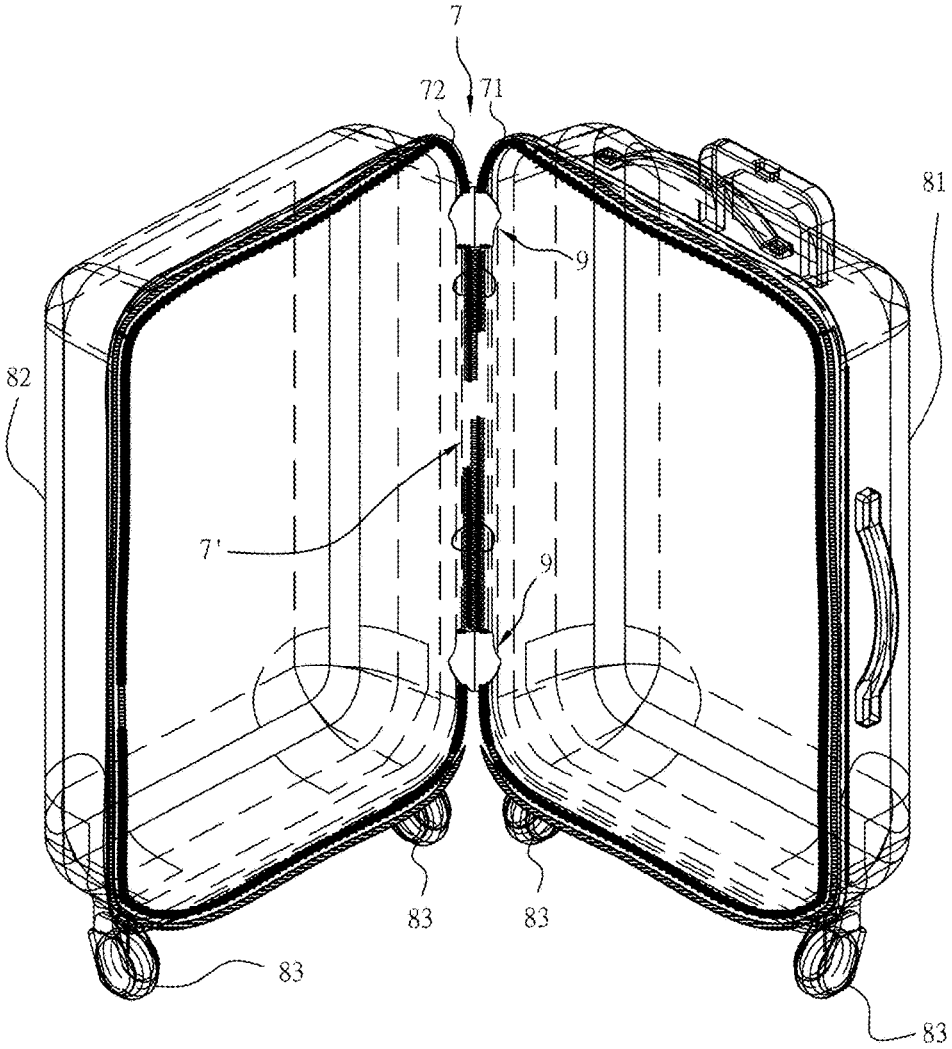
Fig. 1 PRIOR ART
FIG. 1 is a schematic drawing illustrating an opened status of a double open end zipper for both end positioning-based luggage according to the prior art.
Figure 2:
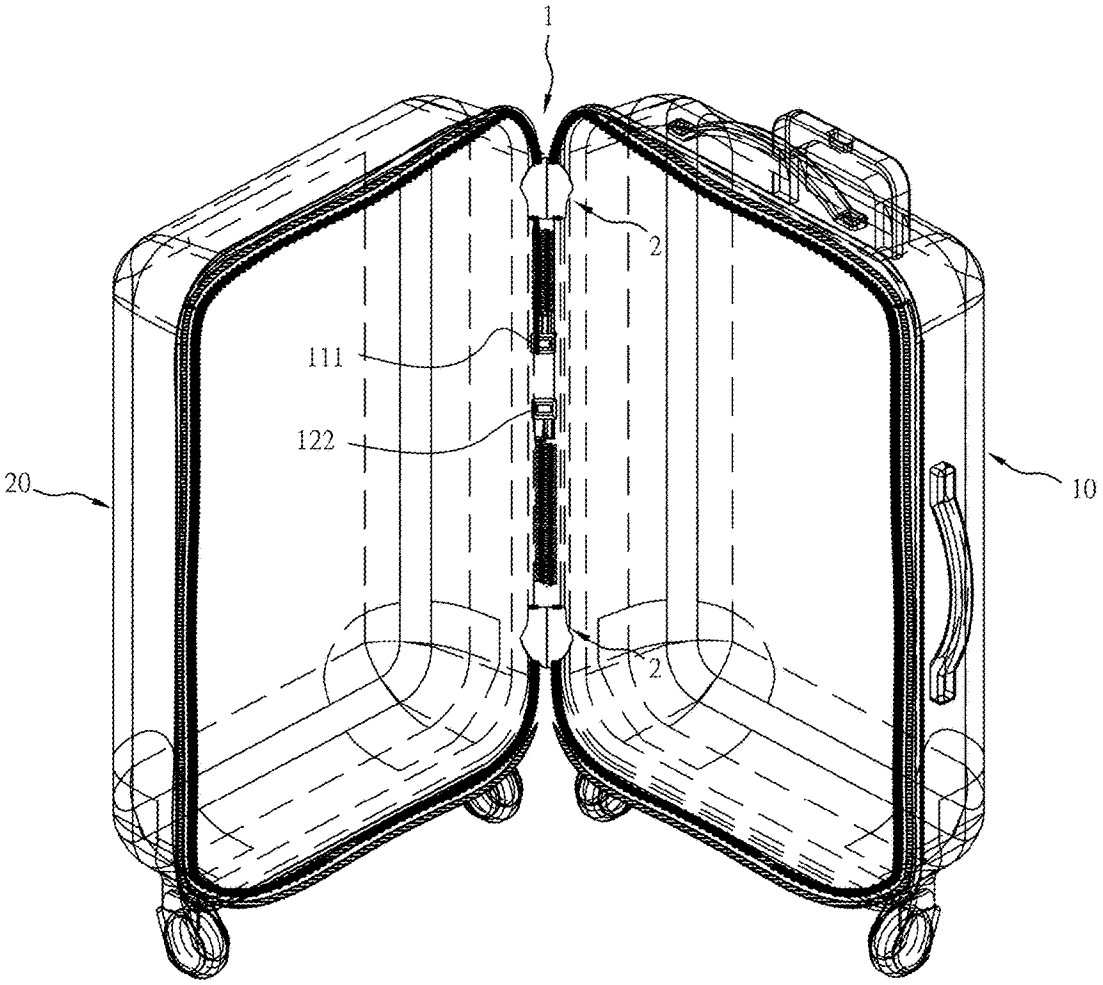
FIG. 2 is a schematic drawing illustrating an opened status of a double open end zipper for both end positioning-based luggage in accordance with a first embodiment of the present invention.
Figure 4:
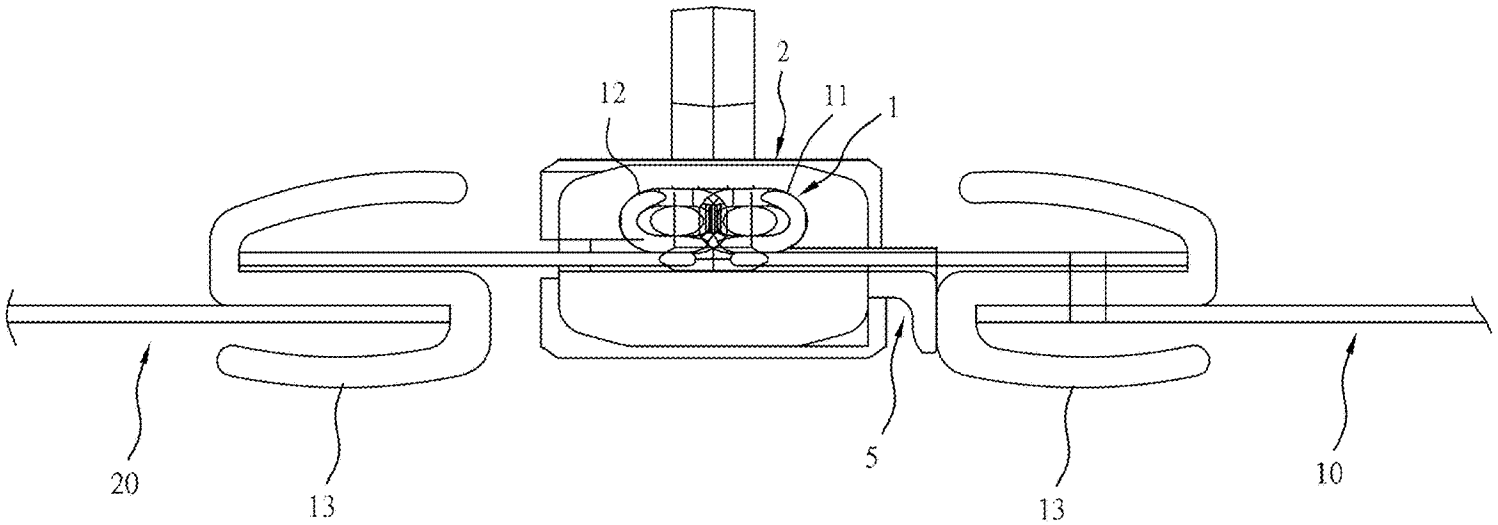
FIG. 4 is a schematic plain view of a part of the double open end zipper for both end positioning-based luggage in accordance with the first embodiment of the present invention.
Figure 5:
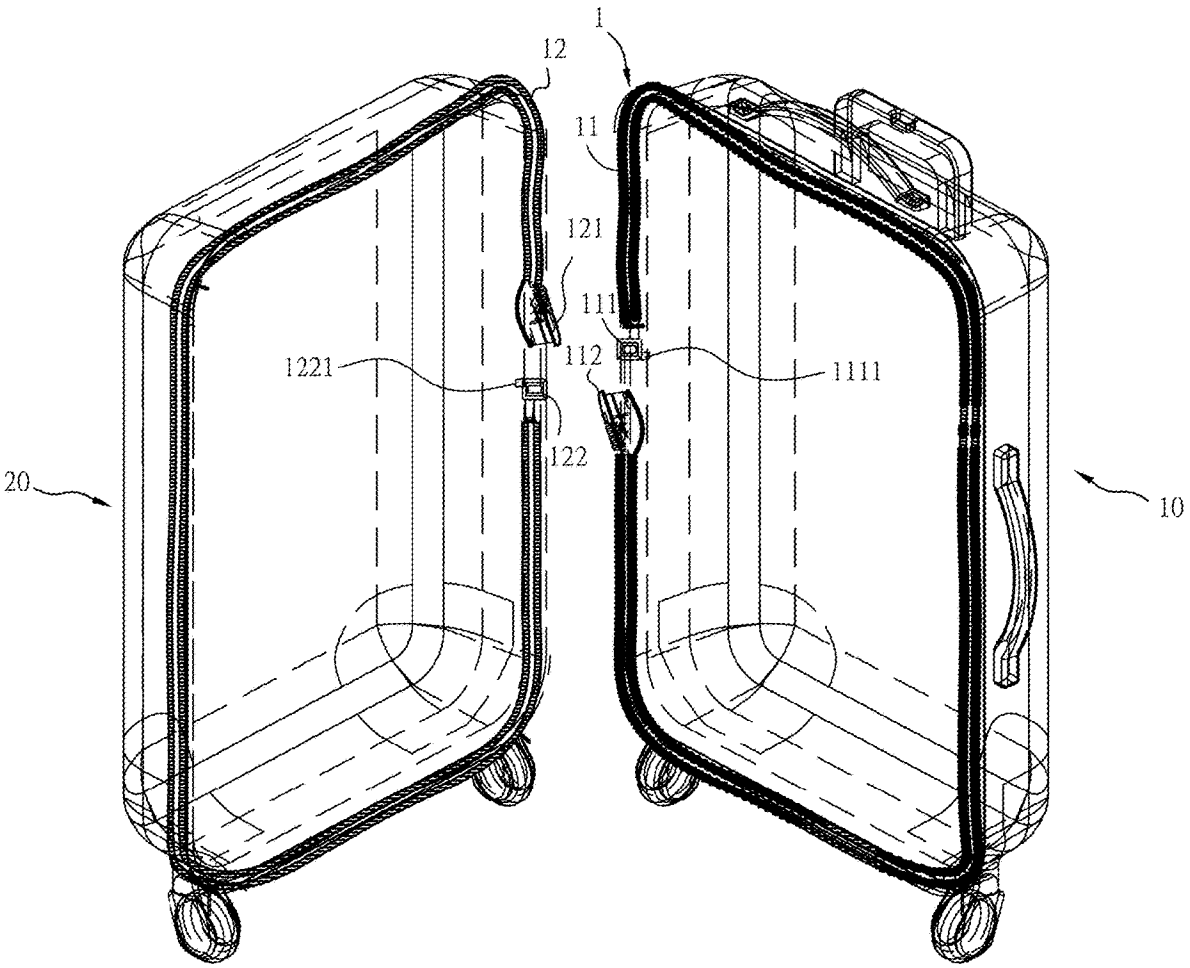
FIG. 5 is an exploded view of a double open end zipper for both end positioning-based luggage in accordance with a second embodiment of the present invention.

II: Zipper stitching: Attach an N-shaped plastic strip 13 to the rim of a first housing member (lower housing member) 10 that is selectively made from PC (polycarbonate) or ABS (acrylonitrile-butadiene-styrene) (see FIG. 4), and then use a L-type gauge, L-type carpenter ruler or other length measurement tool 5 to mark a mark line on the N-shaped plastic strip 13 at the first housing member (lower housing member) 10 as a stitching start point corresponding to the box 111 of the first zipper tape 11, and then stitch the first zipper tape 11 to the rim of the first housing member (lower housing member) 10 in direction from the box 111 of the first zipper tape 11 toward the pin 112 of the first zipper tape 11 to the extent about 1~2 centimeters from the pin 112 of the first zipper tape 11 (see FIG. 3), and then couple the zipper slider 2 to the pin 112 of the first zipper tape 11 and move the zipper slider 2 along the length of the first zipper tape 11 to the box 11 of the first zipper tape 11, and then attach another N-shaped plastic strip 13 to the rim of a second housing member (upper housing member) 20 (see FIG. 4), and then use the same L-type gauge, L-type carpenter ruler or other length measurement tool 5 to mark a mark line on the N-shaped plastic strip 13 at the second housing member (upper housing member) 20 as a stitching start point corresponding to the box 122 of the second zipper tape 12, and then stitch the second zipper tape 12 to the rim of the first housing member (lower housing member) 10 in direction from the box 122 of the second zipper tape 12 toward the pin 121 of the second zipper tape 12 to the extent about 1~2 centimeters from the pin 121 of the second zipper tape 11 (see FIG. 3), and then couple the zipper slider 2 at the first zipper tape 11 onto the pin 121 of the second zipper tape 12 and the zipper slider 2 at the second zipper tape 12 onto the pin 112 of the first zipper tape 11, and then move the two zipper sliders 2 in direction toward each other to force the longitudinal series of teeth at the first zipper tape 11 into engagement with the longitudinal series of teeth at the second zipper tape 12 (see FIG. 2) (As an alternate form of the present invention, the first zipper tape 11 can be stitched to the rim of the first housing member (lower housing member) 10 from the pin 112 to the box 111; the second zipper tape 12 can be stitched to the rim of the second housing member (upper housing member) 20 from the box 122 to the extent about 1~2 centimeters from the pin 121).

III: The invention adopts the technical measures: Draw a mark line as a stitching start point for enabling the first and second zipper tapes 11,12 to be respectively and accurately stitched to the first and second housing members 10,20 so that the zipper sliders 2 can be moved to force the longitudinal series of teeth at the first zipper tape 11 into engagement with the longitudinal series of teeth at the second zipper tape 12 accurately, preventing misengagement and enhancing the quality and fabrication efficiency. This is a luggage fabrication operation of two-way corresponding positioning configuration arrangement.

Referring to FIGS. 5-8, in a second embodiment of the present invention, spacer blocks seam (allowance constraint blocks) 1111,1221 are respectively stitched to the boxes 111,122 of the first and second zipper tapes 11,12 of the double open end zipper 1 (see FIG. 5 and FIG. 6), and a T-shaped protector 3 is mountable in between the first and second housing members 10,20 to shield the spacer blocks (allowance constraint blocks) 1111,1221.

Figure 6:
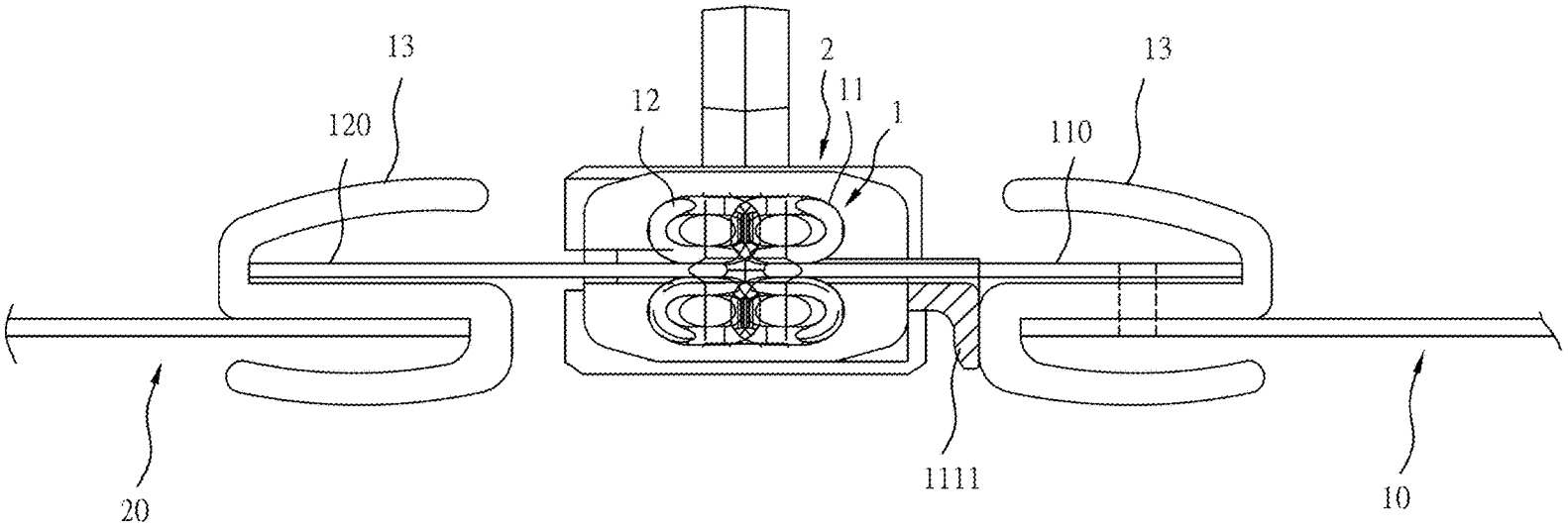
FIG. 6 is a schematic plain view of a part of the double open end zipper for both end positioning-based luggage in accordance with the second embodiment of the present invention.

If the stitching line on each zipper tape is not well controlled, it will affect the smoothness of the sliding of the zipper slider 2. The transverse distance of the stitching line from the outer edge of each zipper tape 11 or 12 of the double open end zipper 1 is determined subject to: ½ of the difference between the largest width at one end of the zipper slider 2 and the smallest width at an opposite end of the zipper slider 2. The difference between the largest width of the zipper slider 2 (at one end of the zipper slider 2) and the smallest width of the zipper slider 2 (at the other end of the zipper slider 2) is approximately equal to the difference between the width of the box 111,122 and the largest width of the zipper slider 2 just because the width of the box 111,122 is approximately equal to the smallest width of the zipper slider 2. The difference between the largest width and the smallest width is divided by 2, and the quotient thus obtained is the minimum value required for single side stitching, and a tolerance about 1~2 mm can be added thereto for allowing free twisting of the zipper slider 2, i.e., in actual practice, a width allowance corresponding to a protruding part (seam allowance constraint block 1111,1221) at the end of the box 111,112 must be provided for the seam allowance in correcting stitching. This innovative measure prevents friction between the zipper sliders 2 and the N-shaped plastic strips 13, facilitating sliding of the zipper sliders 2 and avoiding stretching of the fabric tape bodies 110,120 of the first and second zipper tapes 11,12 (see FIG. 6). Some workers may often neglect to control or could not really understand how to control the seam allowance at the stitching start point, and therefore, it is necessary to attach a seam allowance constraint block 1111,1221 at an outer side of the distal end of the box 111,122 (see FIG. 5 and FIG. 6). As illustrated in FIG. 6, the seam allowance constraint block 1111,1221 is adapted for abutting against or attaching onto the associating N-shaped plastic strip 13 before stitching, ensuring accurate control of stitching alignment and stacked stitching quality. This design of seam allowance constraint block 1111,1221 for abutting against or attaching onto the associating N-shaped plastic strip 13 for the control of the seam allowance is a small improvement but it achieves large effects.

A double open end zipper for both end positioning-based luggage comprises a first housing member (lower housing member) 10 and a second housing member (upper housing member) 20 respectively and selectively made from PC (polycarbonate) or ABS (acrylonitrile-butadiene-styrene), an N-shaped plastic strip 13 attached to a rim of each of the first housing member (lower housing member) 10 and the second housing member (upper housing member) 20, a double open end zipper 1 that comprises a first zipper tape 11 stitched to and extended around the N-shaped plastic strip 13 at the rim of the first housing member (lower housing member) 10, the first zipper tape 11 having a box 111 located at one end thereof and a pin 112 located at an opposite end thereof, a second zipper tape 12 stitched to and extended around the N-shaped plastic strip 13 at the rim of the second housing member (upper housing member) 20, the second zipper tape 12 having a pin 121 located at one end thereof corresponding to the box 111 of the first zipper tape 11 and a box 122 at an opposite end thereof corresponding to the pin 112 of the first zipper tape 11, two zipper sliders 2 respectively coupled to the first zipper tape 11 and the second zipper tape 12 and movable to open and close the first zipper tape 11 and the second zipper tape 12, the first zipper tape 11 being stitched to the N-shaped plastic strip 13 at the rim of the first housing member (lower housing member) 10 from the box 111 toward the pin 112 with an area about 1~2 cm from the pin 112 remained unstitched, the second zipper tape 12 being stitched to the N-shaped plastic strip 13 at the rim of the second housing member (upper housing member) 20 from the box 122 toward the pin 121 with an area about 1~2 cm from the pin 121 remained unstitched, a first seam allowance constraint block 1111 of a predetermined shape protruded from an outer rear side of the box 111 of the first zipper tape 11, and a second seam allowance constraint block 1221 of a predetermined shape protruded from an outer rear side of the box 122 of the second zipper tape 12.

Figure 7:
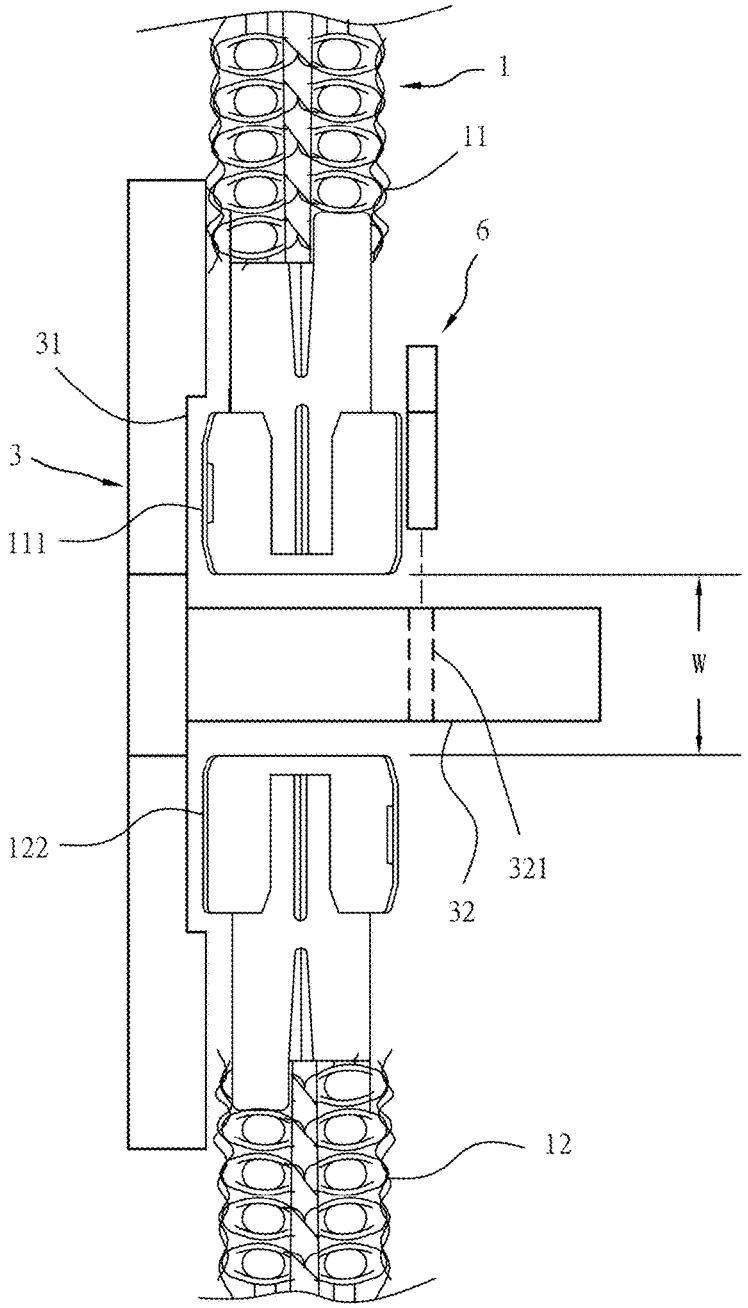
FIG. 7 is a schematic enlarged top plain view of a part of the double open end zipper for both end positioning-based luggage in accordance with the second embodiment of the present invention.
Figure 8:
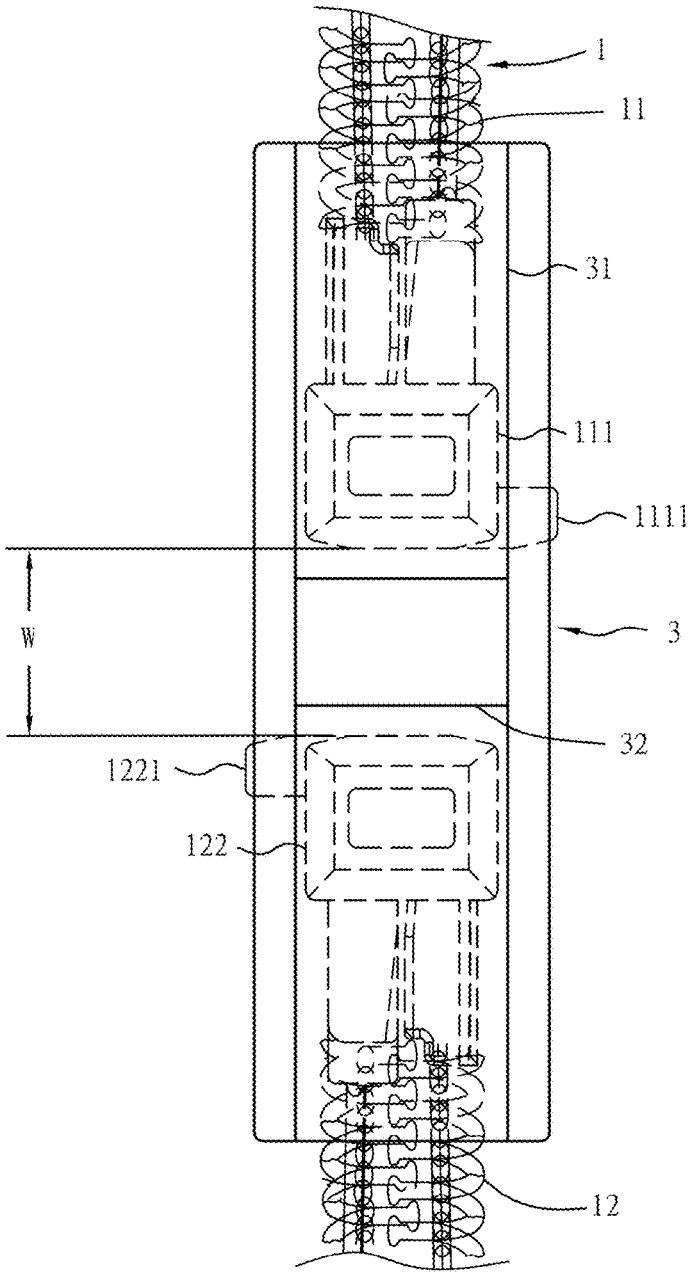
FIG. 8 is a schematic enlarged side view of a part of the double open end zipper for both end positioning-based luggage in accordance with the second embodiment of the present invention.
Figure 9:
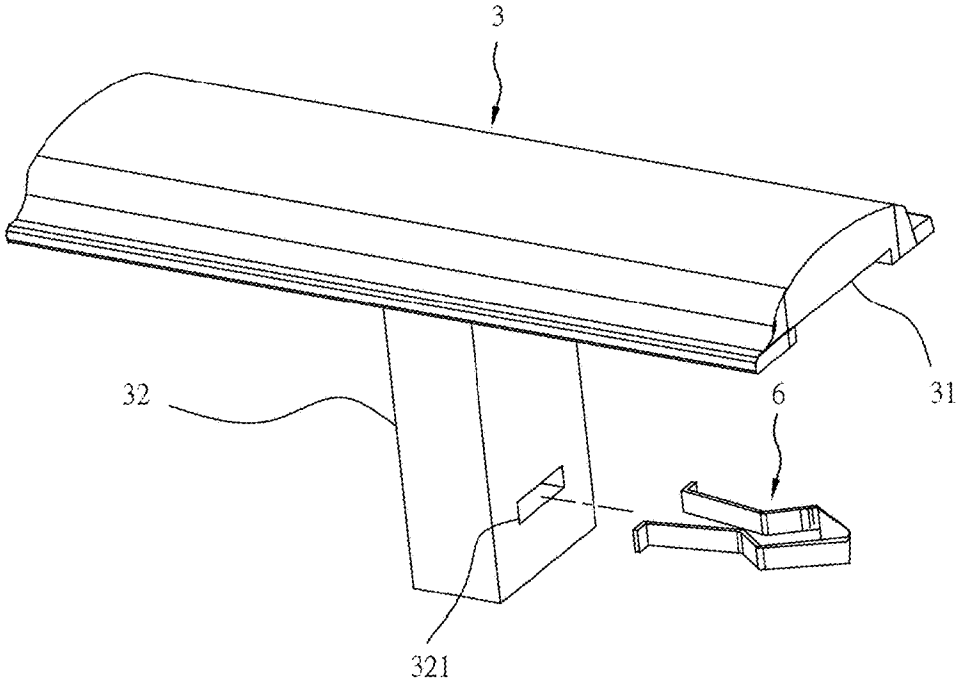
FIG. 9 is an elevational exploded view of the T-shaped protector of the double open end zipper for both end positioning-based luggage in accordance with the second embodiment of the present invention.

Further, after installation of the double open end zipper 1 to join the first housing member (lower housing member) 10 and the second housing member (upper housing member) 20, the luggage thus made can be conveniently opened and closed, and can also be well enclosed after closed the double open end zipper 1. After stitching of the double open end zipper 1 to the first housing member (lower housing member) 10 and the second housing member (upper housing member) 20, the area around the gap W is left between the two boxes 111,122 (see FIGS. 7 and 8), the unstitched area of the first zipper tape 11 about 1~2 cm from the pin 112 and the unstitched area of the second zipper tape 12 about 1~2 cm from the pin 121 are less strong in structure and must be well protected. Therefore, the invention provides the aforesaid T-shaped protector 3 that is mountable in between the first and second housing members 10,20 to shield the boxes 111,122. As illustrated in FIGS. 7-9, the T-shaped protector 3 is inserted in between the two boxes 111,122 from the outside of the luggage toward the inside thereof. The T-shaped protector 3 comprises a transversely extended and grooved shielding head 31 for shielding the boxes 111,122, a flat shank 32 perpendicularly and downwardly extended from the midpoint of the bottom side of the transversely extended and grooved shielding head 31, a transverse slot 321 located in the flat shank 32 near a distal end thereof remote from the transversely extended and grooved shielding head 31, and a spring clip 6 (or any other equivalent retaining means) mounted in the transverse slot 321 for securing the T-shaped protector 3 to the first and second housing members 10,20 in a balanced and detachable manner, keeping the first and second housing members 10,20 well enclosed. Thus, the first housing member (lower housing member) 10 and the second housing member (upper housing member) 20 are detachable and replaceable, and can be respectively marked with a different totem sign for a respective member in a family.

Figure 10:
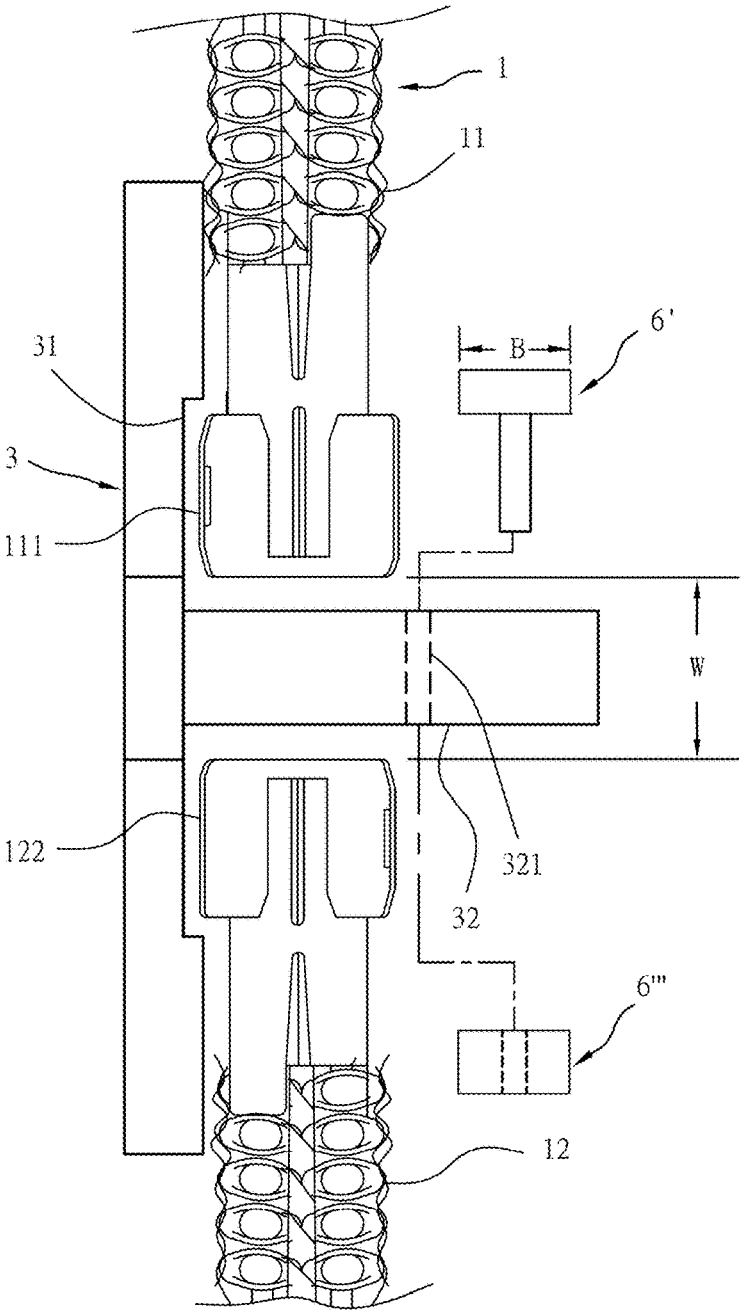
FIG. 10 corresponds to FIG. 7, illustrating male retaining member and a female retaining member used the T-shaped protector instead of a spring clip.

Further, as stated above, the flat shank 32 of the T-shaped protector 3 is inserted in between the two boxes 111,122 from the outside of the luggage toward the inside thereof with the transversely extended and grooved shielding head 31 disposed outside the luggage to shield the boxes 111,122 of the first and second zipper tapes 11, 12, and a the spring clip 6 is mounted in the transverse slot 321 to secure the T-shaped protector 3 to the first and second housing members 10,20 in a balanced and detachable manner, keeping the first and second housing members 10,20 well enclosed. This T-shaped protector 3 can be conveniently fastened to the luggage in a dismountable manner, enhancing connection stability between the first and second housing members 10,20 and holding the first and second housing members 10,20 in a well enclosed condition. Further, in the embodiment shown in FIG. 10, a male retaining member 6' and a female retaining member 6''' are used to replace the aforesaid spring clip 6 for securing the T-shaped protector 3 to the first and second housing members 10,20. The male retaining member 6' is inserted through the transverse slot 321 on the flat shank 32 of the T-shaped protector 3 and fastened up with the female retaining member 6''' to secure the T-shaped protector 3 to the first and second housing members 10,20.

Figure 11:
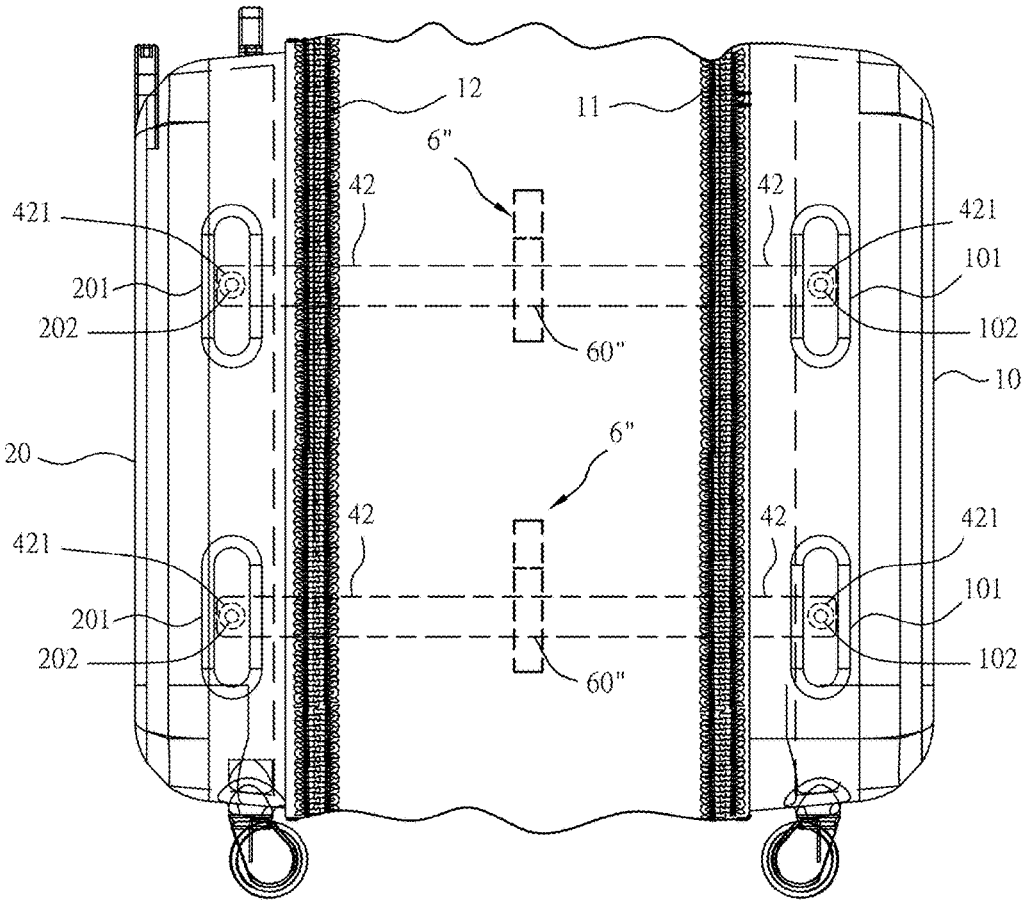
FIG. 11 is a schematic drawing of the present invention, illustrating two stopper members respectively detachably fastened to the semi-flexible plastic reinforcing bars of the aforesaid two reinforcing structures.
Figure 12:
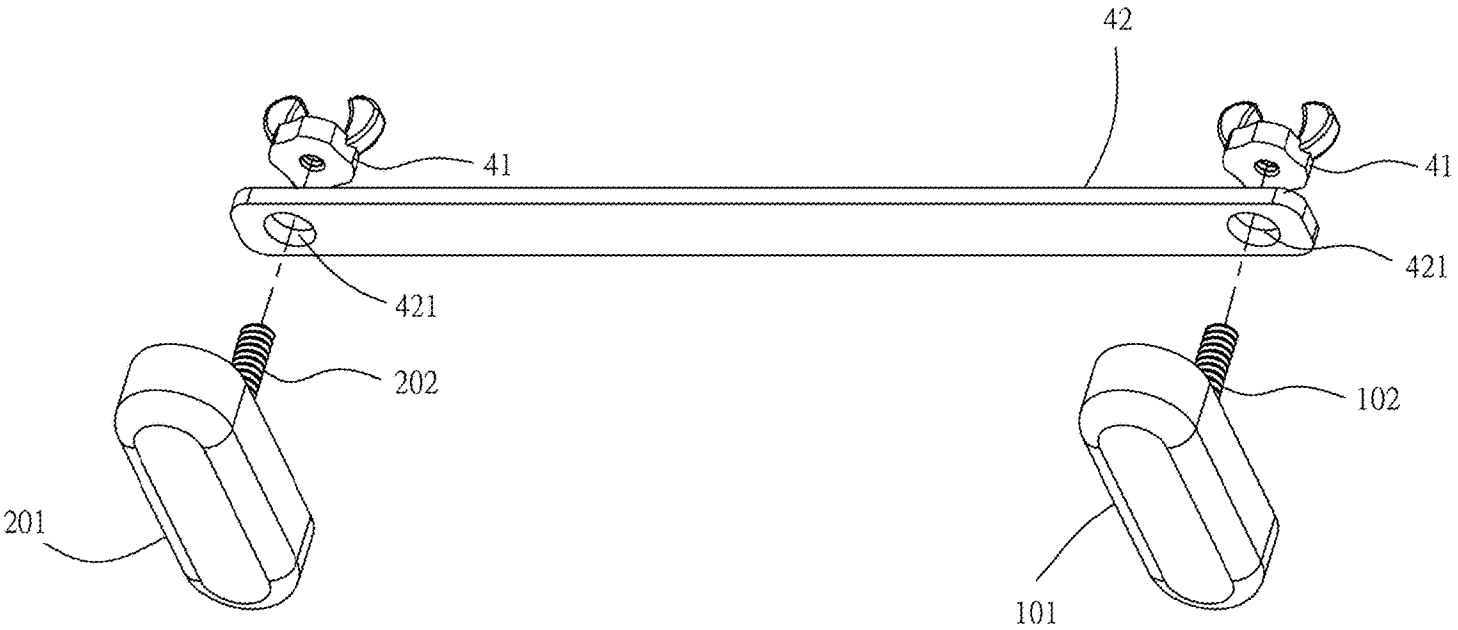
FIG. 12 is an exploded view of one reinforcing structure of the double open end zipper for both end positioning-based luggage in accordance with the second embodiment of the present invention.

The double open end zipper for both end positioning-based luggage further comprises two reinforcing structures, as illustrated in FIG. 11 and FIG. 12. Each reinforcing structure comprises a semi-flexible plastic reinforcing bar 42 that is transversely attached to the first housing member (lower housing member) 10 and the second housing member (upper housing member) 20 on the inside and has two mounting through holes 421 respectively disposed near two distal ends thereof, a first plastic foot member 101 disposed outside the first housing member (lower housing member) 10 and having a threaded stem 102 inserted through the first housing member (lower housing member) 10 and one mounting through hole 421 of the semi-flexible plastic reinforcing bar 42, a second plastic foot member 201 disposed outside the second housing member (upper housing member) 20 and having a threaded stem 202 inserted through the second housing member (upper housing member) 20 and the other mounting through hole 421 of the semi-flexible plastic reinforcing bar 42, and two wing nuts 41 respectively attached to the semi-flexible plastic reinforcing bar 42 opposite to the first plastic foot member 101 and the second plastic foot member 201 and respectively threaded onto the threaded stems 102 of the first and second plastic foot members 101,201 to secure the semi-flexible plastic reinforcing bar 42, the first and second plastic foot members 101,201 and the first housing member (lower housing member) 10 and the second housing member (upper housing member) 20 firmly together. Further, two stopper members 6" are respectively detachably fastened to the semi-flexible plastic reinforcing bars 42 of the aforesaid two reinforcing structures, as illustrated in FIG. 11. Each stopper member 6" has a mounting through hole 60" for the passing of the semi-flexible plastic reinforcing bar 42 of the respective reinforcing structure.

What is claimed is:

1. A double open end zipper for both end positioning-based luggage fabrication method, comprising a step of preparing a zipper comprising a first zipper tape having a box at one end thereof and a pin at an opposite end thereof, a second zipper tape having a box at one end thereof and a pin at an opposite end thereof and two zipper sliders, and a step of fastening said first zipper tape and said second zipper tape to a first housing member and a second housing member that are selectively made from polycarbonate or acrylonitrile-butadiene-styrene wherein the step of fastening said first zipper tape and said second zipper tape to a first housing member and a second housing member is achieved by: attaching an N-shaped plastic strip to a rim of said first housing member, and then using a length measurement tool means to mark a mark line on the N-shaped plastic strip at said first housing member as a stitching start point corresponding to the box of said first zipper tape, and then stitching said first zipper tape to the rim of said first housing member in direction from the box of said first zipper tape toward the pin of said first zipper tape to an extent 1~2 centimeters from the pin of said first zipper tape, and then coupling one said zipper slider to the pin of said first zipper tape and moving the zipper slider along the length of said first zipper tape to the box of said first zipper tape, and then attaching another N-shaped plastic strip to the rim of said second housing member, and then using a same said length measurement tool means to mark a mark line on the N-shaped plastic strip at said second housing member as a stitching start point corresponding to the box of said second zipper tape, and then stitching said second zipper tape to the rim of said second housing member in direction from the box of said second zipper tape toward the pin of said second zipper tape to an extent 1~2 centimeters from the pin of said second zipper tape, and then coupling an other said zipper slider to the pin of said second zipper tape and moving the zipper slider along the length of said second zipper tape to the box of said first zipper tape, and then coupling the said zipper slider at said first zipper tape onto the pin of said second zipper tape and the zipper slider at said second zipper tape onto the pin of said first zipper tape.

2. The double open end zipper for both end positioning-based luggage fabrication method, wherein said zipper is a double open end zipper with said first zipper tape and said second zipper tape respectively stitched to said first housing member and said second housing member in a reversed manner where the pin and box of said first zipper tape are respectively disposed corresponding and adjacent to the box and pin of said second zipper tape.

3. A double open end zipper for both end positioning-based luggage using said double open end zipper and made according to the double open end zipper for both end positioning-based luggage fabrication method as claimed in claim 2.

4. A double open end zipper for both end positioning-based luggage, comprising:

a first housing member and a second housing member respectively and selectively made from polycarbonate or acrylonitrile-butadiene-styrene;

an N-shaped plastic strip attached to a rim of each of said first housing member and said second housing member; and a double open end zipper comprising a first zipper tape stitched to and extended around the N-shaped plastic strip at the rim of said first housing member, said first zipper tape comprising a box located at one end thereof and a pin located at an opposite end thereof, a second zipper tape stitched to and extended around the N-shaped plastic strip at the rim of said second housing member, said second zipper tape comprising a pin located at one end thereof corresponding to the box of said first zipper tape and a box at an opposite end thereof corresponding to the pin of said first zipper tape, two zipper sliders respectively coupled to said first zipper tape and said second zipper tape and movable to open and close said first zipper tape and said second zipper tape, said first zipper tape being stitched to the N-shaped plastic strip at the rim of said first housing member in direction from the box toward the pin of said first zipper tape with an area 1~2 cm from the pin of said first zipper tape remained unstitched, said second zipper tape being stitched to the N-shaped plastic strip at the rim of said second housing member in direction from the box toward the pin of said second zipper tape with an area 1~2 cm from the pin of said second zipper tape remained unstitched, a first seam allowance constraint block of a predetermined shape protruded from an outer rear side of the box of said first zipper tape, and a second seam allowance constraint block of a predetermined shape protruded from an outer rear side of the box of said second zipper tape.

5. The double open end zipper for both end positioning-based luggage as claimed in claim 4, further comprising a T-shaped protector detachably mountable in between said first housing member and said second housing member to shield the boxes of said first zipper tape and said second zipper tape, said T-shaped protector comprising a transversely extended and grooved shielding head for shielding the boxes of said first zipper tape and said second zipper tape, a flat shank perpendicularly and downwardly extended from the midpoint of a bottom side of said transversely extended and grooved shielding head and inserted in between said first housing member and said second housing member, a transverse slot located in said flat shank near a distal end thereof remote from said transversely extended and grooved shielding head, and a spring clip mounted in said transverse slot to secure said T-shaped protector to said first housing member and said second housing member.

* * * * *